US006567997B2

(12) United States Patent
Harper

(10) Patent No.: US 6,567,997 B2
(45) Date of Patent: May 27, 2003

(54) MOBILITY ASSISTING DEVICE FOR USE PRIMARILY BY HEMIPLEGICS

(75) Inventor: Morley Harper, St. Louis, MO (US)

(73) Assignees: Shamrock Product Development Inc., St. Louis, MO (US); Shamrock Product Development Ltd., Winnipeg (CA)

( * ) Notice: Subject to any disclaimer, the term of this patent is extended or adjusted under 35 U.S.C. 154(b) by 0 days.

(21) Appl. No.: 09/879,044

(22) Filed: Jun. 13, 2001

(65) Prior Publication Data

US 2002/0021039 A1 Feb. 21, 2002

Related U.S. Application Data

(60) Provisional application No. 60/211,274, filed on Jun. 13, 2000.

(51) Int. Cl.[7] ..... A61G 7/02
(52) U.S. Cl. ..... 4/480; 4/254; 297/217.7
(58) Field of Search ..... 4/254, 476, 478, 4/480, 483; 135/66; 297/217.7, 423.19

(56) References Cited

U.S. PATENT DOCUMENTS

| | | | | | |
|---|---|---|---|---|---|
| 250,396 | A | * | 12/1881 | Russell | 4/483 |
| 588,829 | A | * | 8/1897 | Johnson | 4/480 |
| 1,067,767 | A | * | 7/1913 | Simonson | 4/254 |
| 2,899,869 | A | * | 6/1959 | Hoyt et al. | 297/217.7 |
| 4,613,994 | A | * | 9/1986 | Oates | 4/480 |
| 5,787,515 | A | * | 8/1998 | Mason et al. | 4/254 |

* cited by examiner

*Primary Examiner*—Robert M. Fetsuga
(74) *Attorney, Agent, or Firm*—Adrian D. Battison; Michael R. Williams; Ryan W. Dupuis

(57) ABSTRACT

A mobility assisting device is bedside durable medical equipment (DME) designed especially for those who do not have full use of all of their limbs; more specifically, for those who have use of only one arm and one leg on the same side of the body. Such people, hemiplegics, have limited capabilities for performing physical acts and are very dependent upon caregivers, in order to perform their basic activities of daily living. The bedside special needs assistive device makes certain simple tasks easier for hemiplegics to perform, and makes difficult, more complex tasks possible for them to perform on an independent basis. Specifically, it provides a chair construction and three vertical pull-poles designed in a triangle to allow the patient to pass from a bed on one side to the chair and from a wheel chair on the other side to the chair and thus assists its user to shift body position in bed, to rise from a prone to a sitting position on their bed, to transfer back and forth between their bed and the built-in commode, between their bed and their wheelchair, between their wheelchair and the built-in commode, and depending upon the degree of their paralysis and upon the adaptive dressing devices that they have, to perform most if not all of the steps necessary in getting dressed by themselves. A rotatable disk is provided at the base between the poles for receiving the ball of the good foot of the patient to allow swiveling while holding one of the pull poles. One or two wings may be provided on the disk to carry the ineffective foot while the good foot controls the movement thus allowing both clockwise and counter clockwise rotation.

18 Claims, 13 Drawing Sheets

FIG. 15
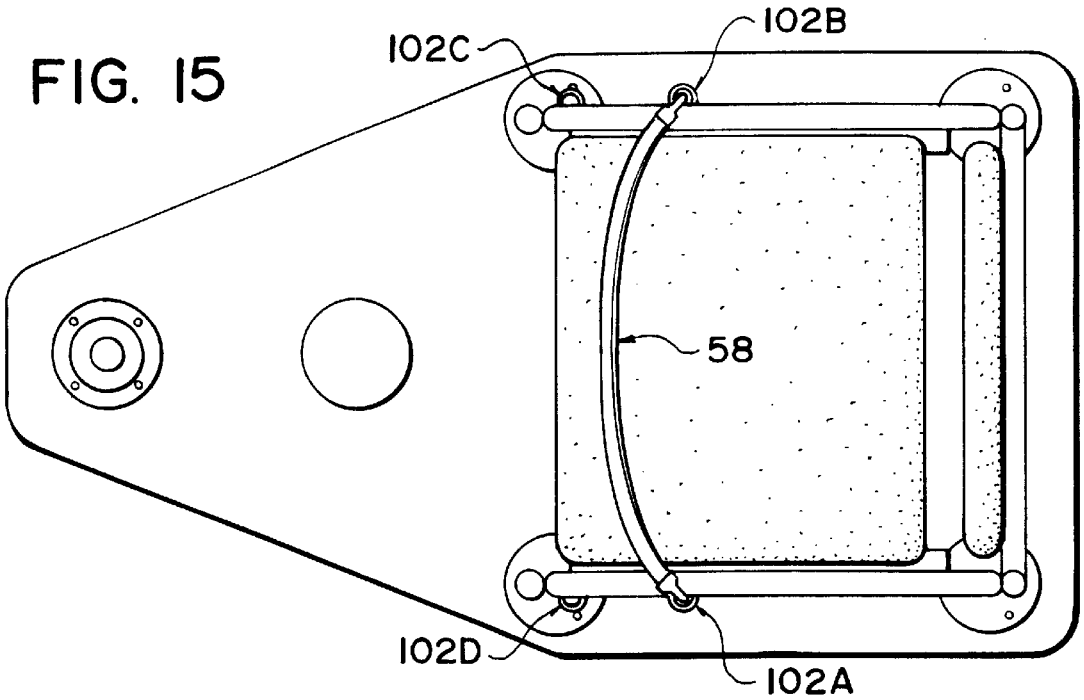
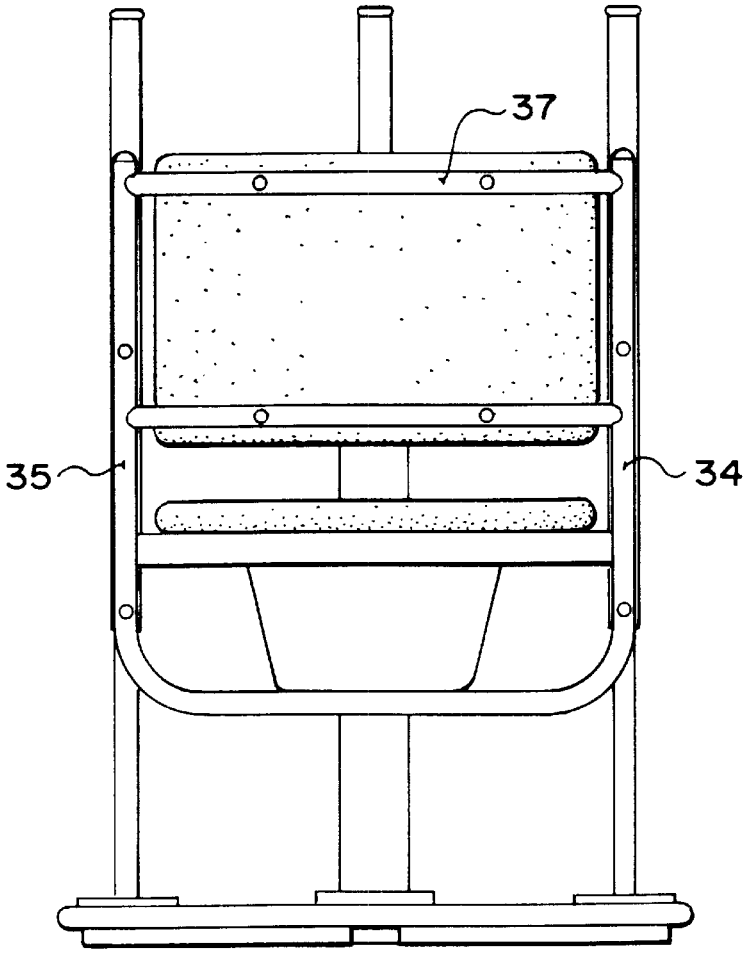
FIG. 16

MOBILITY ASSISTING DEVICE FOR USE PRIMARILY BY HEMIPLEGICS

This application claims the benefit of Provisional application Ser. No. 60/211,274, filed Jun. 13, 2000.

This application relates to a similar device as disclosed in co-pending application Ser. No. 09/506,804 filed Feb. 18, 2000 the disclosure of which is incorporated herein by reference.

This invention relates to a mobility assisting device which is primarily but not exclusively designed for assisting hemiplegics, that is generally stroke victims who are often paralyzed or at least of restricted ability along one side, in dressing, mobility and toiletting. One aspect of the device relates to a construction of commode which can be provided as part of the device. Another aspect of the device relates to a construction of poles, rails and turntable which assists the user in mobility.

BACKGROUND OF THE INVENTION

The American Heart Association claims that "each year, about 600,000 people suffer a new or recurrent stroke". Some of these stroke victims recover nearly to their pre-stroke conditions. However, a much larger number are burdened with permanent disabilities that leave them with varying degrees and forms of incapacitation. The subject invention is intended to help in the rehabilitation and recovery of those whose incapacitation involves their mobility; specifically hemiplegics and others who are similarly afflicted

SUMMARY OF THE INVENTION

It is one object of the present invention to provide an improved device which assists physically infirm patients in rising, dressing, toiletting and similar activities.

According to a first aspect of the invention there is provided a mobility assisting device for infirm patients comprising:

a base surface on which the patient can stand;

a chair construction on the base surface having two side rails and a horizontal seat;

three vertical pull-poles extending upwardly from the base surface arranged thereon generally at apexes of a triangular pattern for the patient to pull on for standing up, or for lowering back to a sitting position;

a first of the pull-poles being arranged at the front of the chair on one side, a second of the pull-poles being arranged at the front of the chair on the other side and a third of the pull-poles being spaced forwardly of the chair between the first and second poles with the poles being spaced such that the user can pass between the first and third poles to enter or leave the chair from one side and between the second and third poles to enter or leave the chair from an opposed side.

Preferably there is provided a pivot disk located on the base surface adjacent at least one of the pull-poles shaped and arranged to receive one foot of the patient while holding one of the pull-poles and rotatable about a vertical axis relative to the base surface such that the patient can pivot on the pivot disk and thereby point their posterior in a required direction in order to sit down on an object of their choice.

Preferably the pivot disk is arranged generally centrally between the pull-poles.

Preferably the pivot disk has a central portion arranged to receive the ball of the good foot of the patient and a wing or wings projecting outwardly from the pivot axis shaped to receive and support the ineffective foot of the patient so that the ineffective foot is carried around on the wing of the disk while the good foot swivels with the disk and the heel of the good foot can be used to stop or control the rotation of the disk.

Preferably the base surface comprises a floor that establishes and maintains the relative positions of the pull-poles, the pivot disk and the seat.

Preferably the chair includes a commode.

Preferably a cover for the commode comprises a bench seat.

Preferably the commode includes a toilet seat and the bowl is odor sealed by a seal underneath the bench seat which sits on the toilet seat and a seal under the toilet seat which sits on the bowl.

Preferably there is provided a restraining belt across side rails of the chair construction to keep a one-handed user from falling forward and being injured while dressing.

Preferably there is provided lean-against safety bars between the pull-poles to lean against when standing while dressing.

Preferably there is provided a quick adjust mechanism to adjust a height of the seat relative to the chair In one alternative there is provided a mounting frame for holding the chair construction and the pull-poles in position and wherein there is provided an adjustable pin-down jack by which is arranged to imposes the weight of an adjacent bed between a bed frame and a pin-down bar attached to the mounting frame, thereby making the device tip-over-resistant.

In another alternative there is provided an outrigger stabilization system in which outriggers attached to the base surface at each of a plurality of footpads of the chair construction to make the base surface effectively wider from a stabilization standpoint.

In another alternative there is provided a stick-down stabilization system in which a stick-down plate is attached to an underside of the base surface which utilizes self-sticking hook and loop strips to stick the base surface to a hard surfaced floor, thereby making the device tip-over-resistant while still providing transferability.

In yet another alternative there is provided ballast tanks attached to legs of the chair construction and resting on the base surface on respective sides of the chair construction to counteract the tip-over torque generated by a pull on a pole or a lunge of the body against the chair construction.

According to a second aspect of the invention there is provided a mobility assisting device for infirm patients comprising:

a base surface on which the patient can stand;

at least one vertical pull-pole standing upwardly from the base surface for grasping by the patient to assist in moving from one place to another place;

and a pivot disk located on the base surface adjacent the pull-pole shaped and arranged to receive one foot of the patient while holding the pull-pole and rotatable about a vertical axis relative to the base surface such that the patient can pivot on the pivot disk and thereby point their posterior in a required direction in order to sit down on an object of their choice.

According to a third aspect of the invention there is provided a mobility assisting device for infirm patients comprising:

a chair construction having two side rails and a horizontal seat;

at least one pull-pole arranged at the front of the chair for grasping by the patient while sitting in the chair;

the chair including a commode having a removable bowl, a toilet seat on top of the bowl and a raisable bench seat for covering the bowl and the seat;

wherein the bowl is odor sealed by a seal underneath the bench seat which sits on the toilet seat and a seal under the toilet seat which sits on the bowl.

The pivot disk may have a single or double winged version on which to place the foot of the paralyzed leg, thus enabling the user to rotate in either direction equally well. Otherwise a right-side-normal hemiplegic must rotate in a counterclockwise direction to effectively drag their paralyzed left leg along when rotating. Similarly, a left-side-normal hemiplegic must rotate in a clockwise direction.

Preferably the device includes a floor that establishes and maintains the relative positions of the pull-poles, the pivot disk and the seat.

Preferably the floor has a steel stiffener frame on the underside to counteract the significant bending torque imposed on it by a pull on any one of the three pull-poles. This requires leveler bars at the rear legs, of the same height as the stiffener, in order to maintain a level floor.

Preferably the device has a stabilization system in the form of pin-down bars, outriggers, or stick-down plates attached to the underside of the floor, or ballast tanks on the top, to counteract the tip-over-torque generated by a pull on a pull-pole or an out-of-control lunge of the body against any part of the device; the addition of one of these stabilization systems makes the assistive device tip-over-resistant. The means of stabilization employed is determined by the type of installation (fixed location or relocatable) and the surface on which the device is installed (carpeted or hard surfaces).

Preferably the device has a built-in, tip-over-resistant commode at the seat for toilet activities.

Preferably the cover for the built-in commode acts as a bench seat for sit-down activities such as dressing.

Preferably the commode is odor sealed by the simple one step process of lowering the bench seat. This also makes preparing the commode for use, the simple one step process of raising the bench seat. The bench seat has a seal underneath which sits on the toilet seat and a seal under the toilet seat which sits on the removable bowl. This feature can also be used independently of the previous elements in a seat and commode construction.

Preferably the device includes a pin-down stabilization system in which pin-down bars attach to the underside of the floor, in conjunction with adjustable pin-down jacks spanning the distance to the bed frame, enabling the weight of the bed to be imposed on the floor of the device, thereby making the assistive device tip-over-resistant.

In spite of their disabilities, many hemiplegics, relearn how to perform many tasks for themselves, through rehabilitation. One of the techniques that they learn to use for transferring from one object to another, is known as a stand and pivot maneuver. In this maneuver, they pull themselves to a standing position from the seat of the origination object, pivot their body to line it up with the destination object to which they wish to transfer, and then sit down on their destination object. This invention enables them to apply this maneuver to make safe and easy transfers, back and forth, between their bed, the built-in commode, and their nearby parked wheelchair.

Hemiplegics do not have a free hand to hold onto the various objects that they must interact with. Therefore it is especially important from a safety standpoint, that all such objects be held in place by some means. A stand alone detached bedside commode is an example of a dangerous object for a hemiplegic to transfer onto unless it is being held firmly by a caregiver.

Many hemiplegics, who use the regular bathroom need a caregiver to help them transfer to their wheelchair or to transfer to the toilet when they get to the bathroom. The transfer capabilities of the special needs assistive device and its built-in commode enables a hemiplegic to take care of a 2:00 am toilet need alone without having to awaken their caregiver.

It is difficult for a one-handed person to maintain their balance while performing the activities of daily living of getting dressed and voiding themselves, unless they have help or they have something to lean against. The invention provides an easily deployed seat belt and easily deployed standing up lean bars (two of) to provide a safer environment in which to perform the above mentioned activities of daily living.

In summary, the invention is intended for use in rehabilitation facilities, skilled nursing homes and private homes, and its aim is to help hemiplegics and others similarly afflicted, to become as independent as their determination and limited capabilities will take them.

BRIEF DESCRIPTION OF THE VIEWS OF THE DRAWING

The following figures show a number of embodiments of the assistive device including a first embodiment configured for a right side normal (disabled left side) person. For a left side normal person.

FIG. 1 is an isometric drawing of a special needs assistive device according to the present invention.

FIG. 2 is a top plan view of the device of FIG. 1.

FIG. 3 is a rear elevational view of the device of FIG. 1.

FIGS. 14 to 18 correspond to FIGS. 1, 2, 3, 4 and 6 and show the same illustrations of a second embodiment designed for clinical or institutional use.

DETAILED DESCRIPTION OF THE INVENTION

Figure 14:
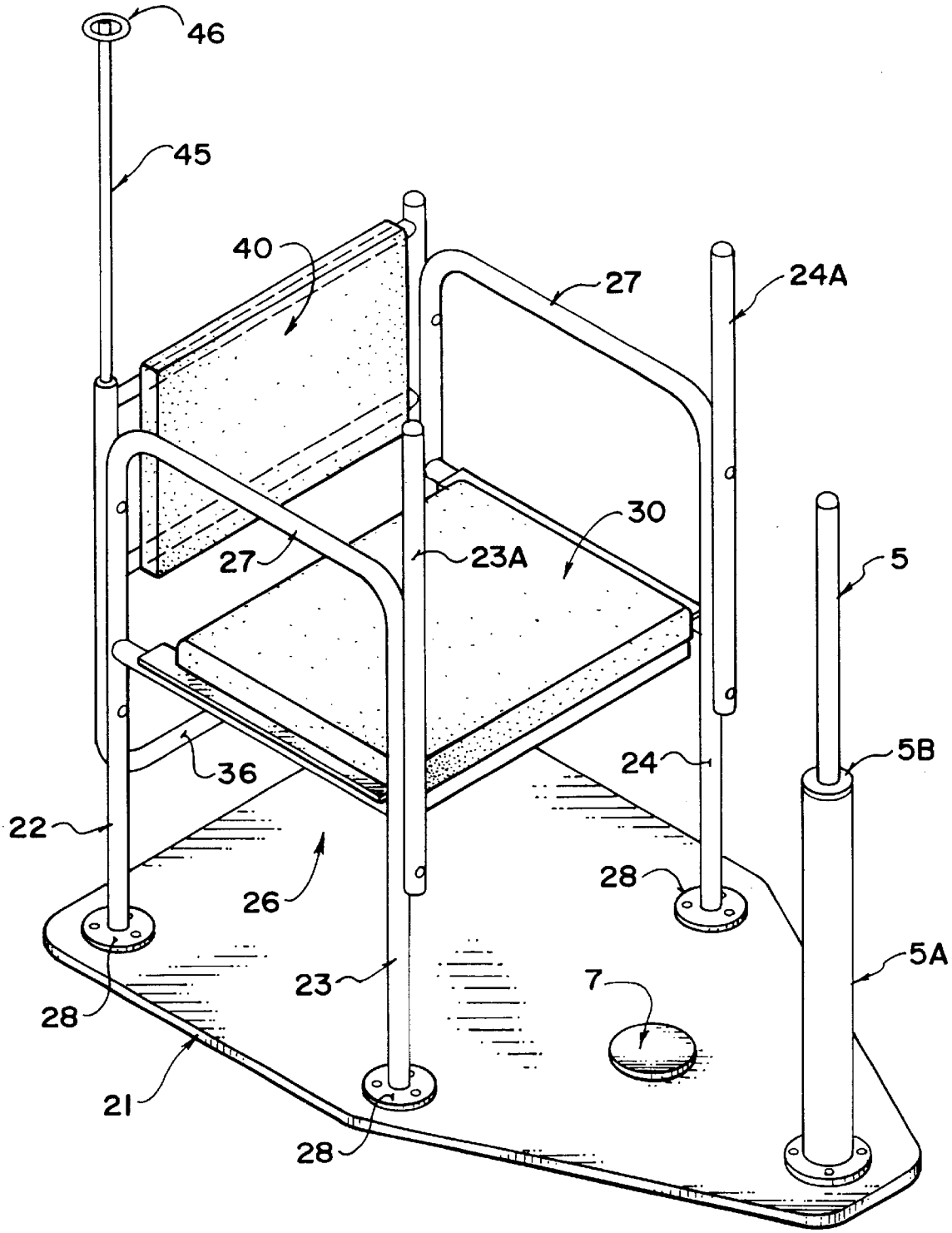
Figure 17:
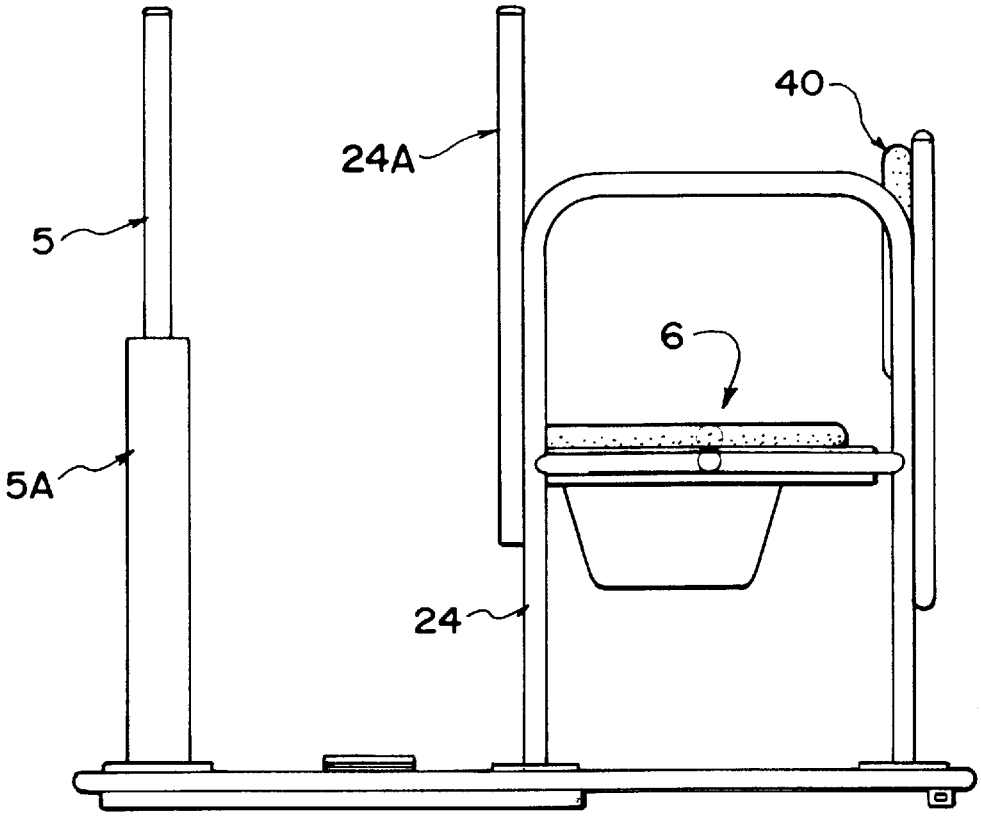

There are two configurations of the device described herein; a rectangular shaped residential configuration (FIG. 1) and a clinical configuration (FIG. 14) herein after referred to as "residential" and "clinical" respectively. The residential unit is not symmetrical about its longitudinal axis (see FIG. 2), and when assembled, it is built for either a left-side-normal hemiplegic or a right side-normal hemiplegic. This unit takes up less bedside floor space which makes it better suited for limited floor space residential applications.

The clinical unit is symmetrical about its longitudinal axis (see FIG. 15), and when assembled it can be used by left side and/or right side-normal hemiplegics without the need for any reconfiguration, which makes it operationally flexible and well suited for physiotherapy clinics, hospitals and assisted living situations.

In all there are 16 combinations of the 4 variables; hemiplegic, device, installation and surface types. This patent application does not attempt to detail all combinations, but it attempts to detail a sufficient number that the phrase "by similarity" carries the others.

Figure 2:
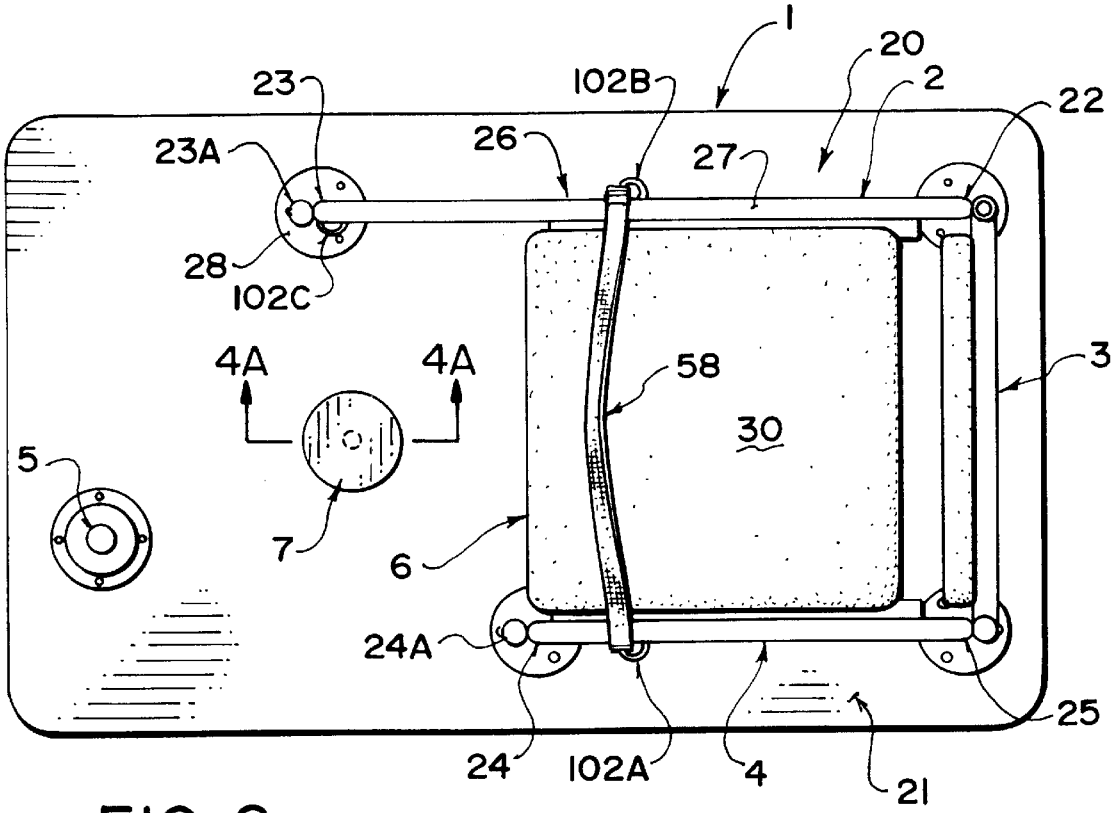
Figure 3:
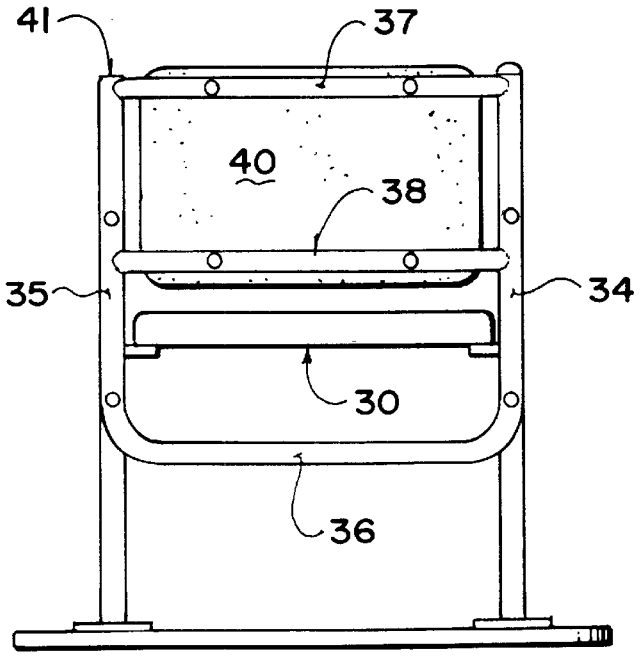

As shown in FIGS. 2 and 15, the special needs assistive device is composed of six main subassemblies; 1, the floor assembly; 2, the right side-rail assembly including its pull-pole; 3, the rear frame assembly; 4, the left side-rail assembly including its pull-pole; 5, the stand alone pull-pole assembly; and 6, the built-in commode assembly. Also identified in the figures is a subassembly of the floor assembly 1 which is the pivot disk assembly 7.

Turning now to the FIGS. 1 through 4, the device comprises generally a chair shaped structure 20 mounted on a horizontal flat base 21. The chair has four legs 22, 23, 24 and 25 which are arranged at four corners and each is spaced inwardly from a respective edge of the base 21 so that the side edges of the base are spaced outwardly from the sides of the legs and the front and rear edges are spaced forwardly and rearwardly respectively of the front and rear of the legs. The legs 22 and 23 form part of a side frame 26 defined by the legs together with a top rail 27. The legs and the top rail are U-shaped so that the legs project downwardly to bottom flanges 28 attached to the plate 21. A horizontal cross rail 29 parallel to the top rail 27 joins the legs and thus forms a rigid structure for the side frame.

A padded seat 30 bridges between the horizontal rails 29 with a rear edge 31 adjacent the legs 22 and 25 and a front edge 32 spaced rearwardly from the leg 23 and adjacent the leg 24. The seat can be pivotal about a rear pivot axis so that it can lie generally in a vertical plane at the legs 22 and 25.

On the residential unit, the leg 23 is spaced forwardly from the leg 24 so that the side frame on that side is longer than the other side frame. Thus the side rail 27 projects forwardly from the seat.

A rear frame 33 comprises a U-shaped member with upstanding arms 34 and 35 together with a bottom horizontal rail 36. The U-shaped member is braced by cross rails 37 and 38 with the rail 37 at the top of the arms 34 and 35 and the rail 38 spaced downwardly but above the height of the seat so as to receive between the rails 37 and 38 a padded seat back 40. The seat back thus lies in a vertical plane which is common to the legs 22 and 25.

An upper end of the arms 34 and 35 forms an open tubular mouth or sleeve 41. It will be appreciated that the U-shaped members and rails forming the structure are formed from tubular metal so that each can act as a readily graspable rail. The rails are bolted or welded together to form a rigid structure which has sufficient strength to accommodate the forces of the infirm patient leaning vigorously against the structure in the event of a sudden loss of balance.

A mast 45 formed of a rod or tube of smaller diameter than the sleeve 41 is inserted into one or both of the arms 34 and 35 so as to stand upwardly from the back of the chair structure. The rod has a ring or receptacle 46 at its upper end onto which the hook of a clothes hanger can be engaged for hanging the clothes of the patient from the closet prior to dressing in the clothes.

The rails 27 are at a height raised relative to conventional arms of a chair so that they can act as support rails while the patient is standing so that one hand of the patient while standing can grasp the rail to hold the patient steady.

The chair structure thus has its own floor or is attached to the floor directly so that the presence of the floor panel enables the weight of the user standing within the boundaries of the chair rails to fix the chair to its location. However, before the full weight of the user comes to bear on the floor, a significant tip-over torque is generated by the pull on the pole used to stand up. All four of the stabilization systems counteract the tip-over torque; the pin-down, the stick-down and the ballast tank systems by applying an "artificial weight" on the floor, the outriggers by making the floor "artificially wider".

The pull on the rails or legs of the assistive device while reorienting the body in bed or while rising to a sitting position generate, primarily, a horizontal force that tends to cause a sliding or skidding movement of the device on the facility floor. To prevent this movement, a non-skid material has been added to the underside of all assistive devices surfaces coming in contact with the facility floor; the stiffener, the levelers, the outriggers, the pin-down bars, etc.

In an embodiment where there is no commode, the fold-up seat can be folded into the raised position to provide extra standing room if necessary during certain dressing tasks. The attachment of the side frames to the floor panel provides a structural stability that is not dependent upon the seat so that the frame will accommodate significant loads should the patient fall against the frame.

The location for mounting the rail cross-members, 29, onto the legs is adjustable in height so that the seat height can be set so that the person resting against the seat has their buttocks above their knees similar to sitting on a kitchen stool to facilitate rising.

Figure 1:
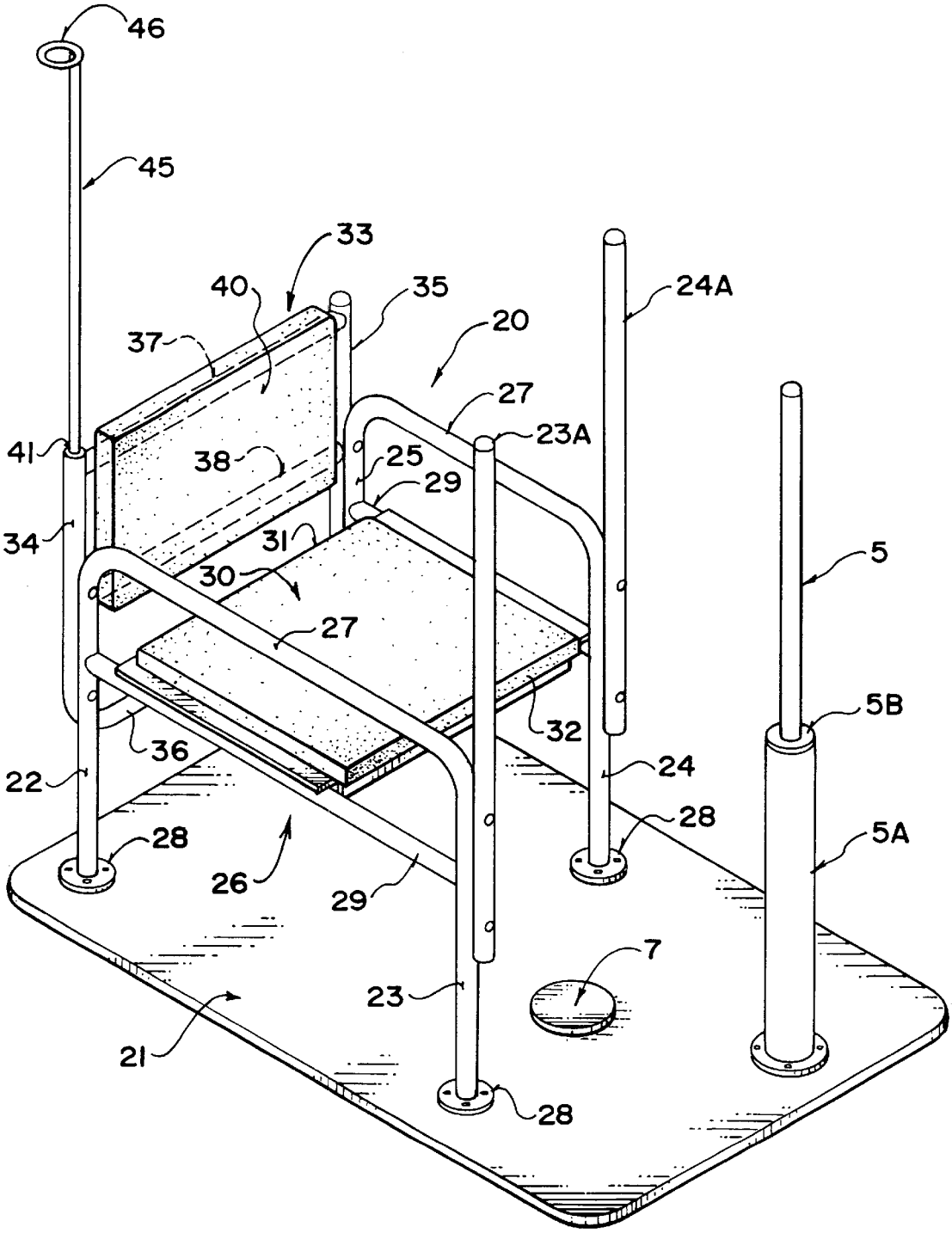
FIGS. 1 to 3 are mirror images of those shown. Except for the floor, the subassemblies are the same for both versions. Also a second embodiment is designed to be symmetrical and thus usable in an institution by persons of either side disability.
Figure 4:
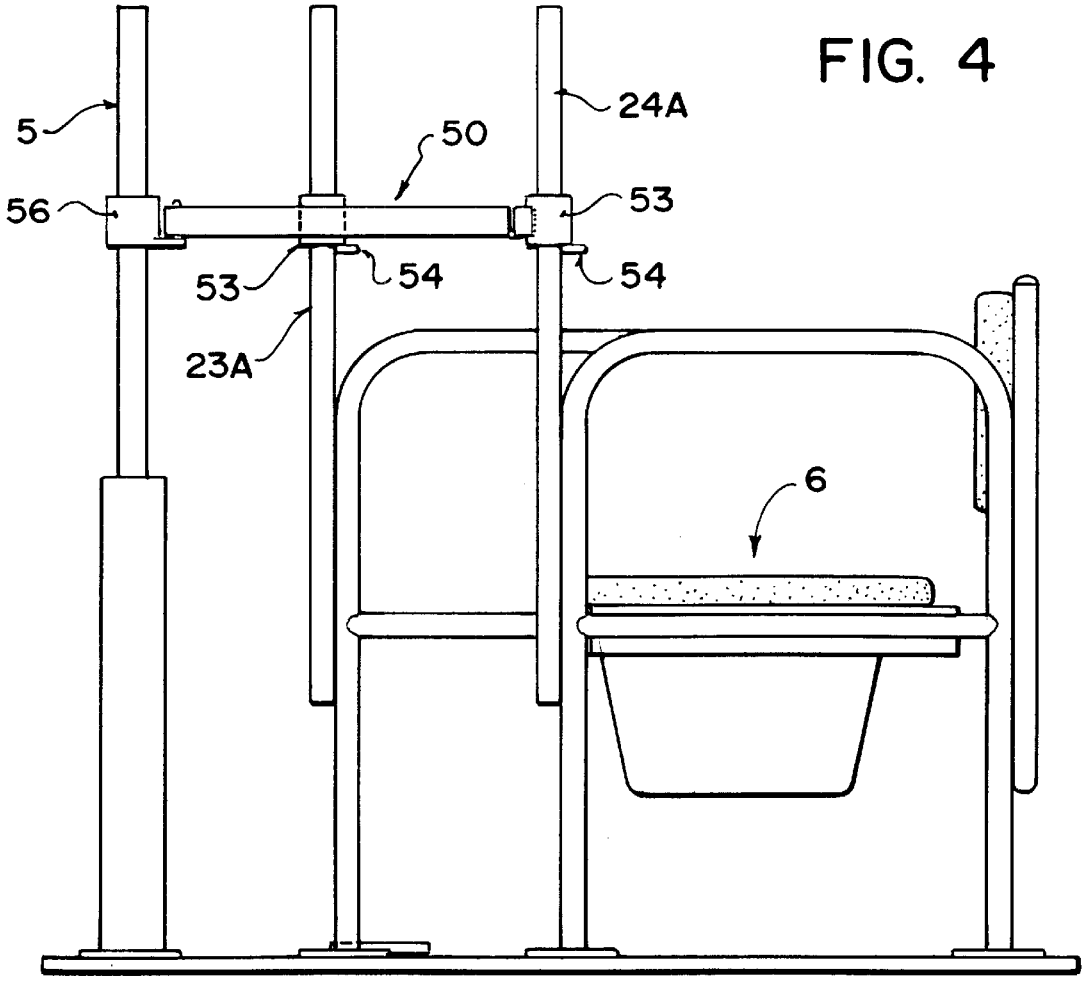
FIG. 4 is a side elevational view of the device of FIG. 1.
Figure 6:
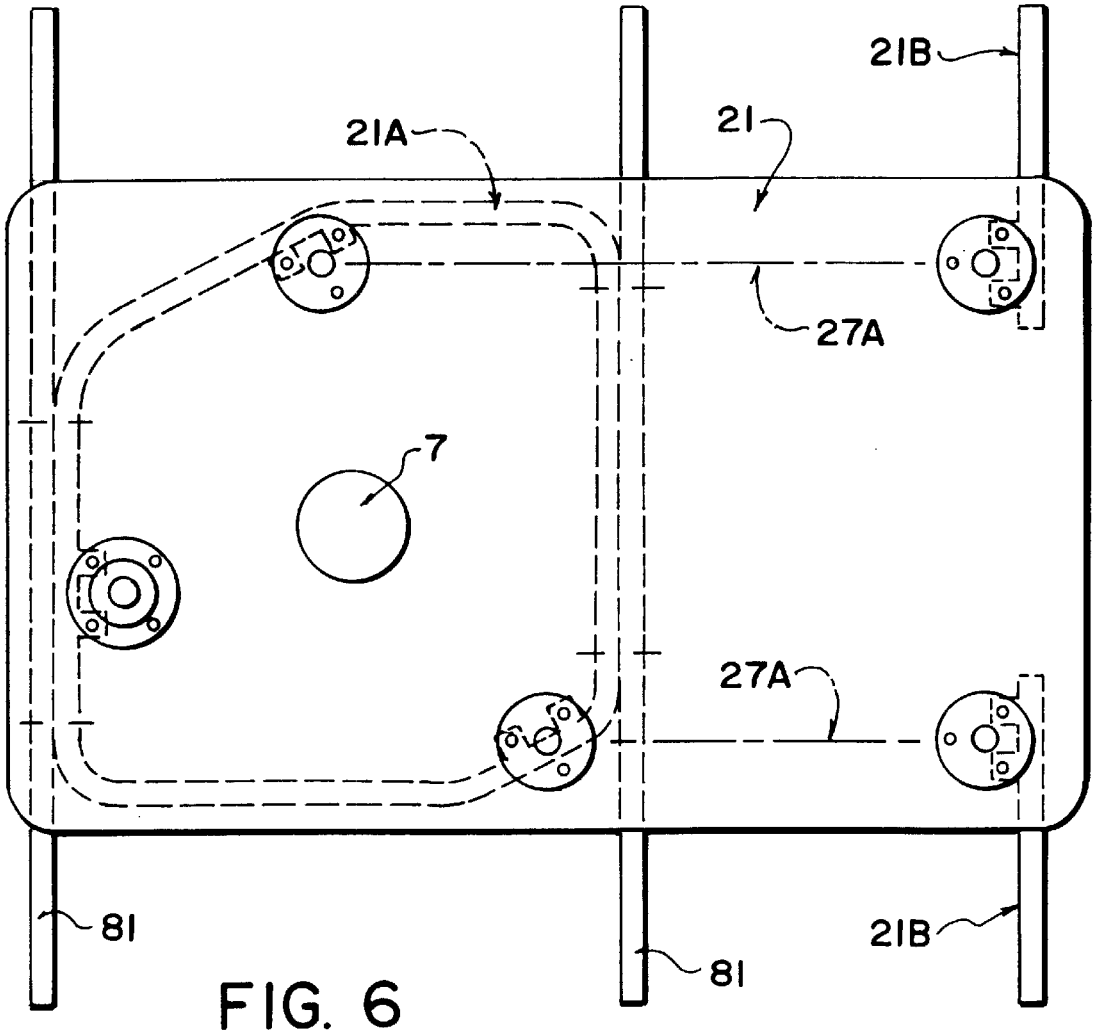
FIG. 6 is an top view of the device of FIG. 2 showing the floor with mounting hole patterns of the foot pads, and showing in dash line the stiffener frame, the leveler bars, the outriggers and the pivot disk retaining hardware.
Figure 18:
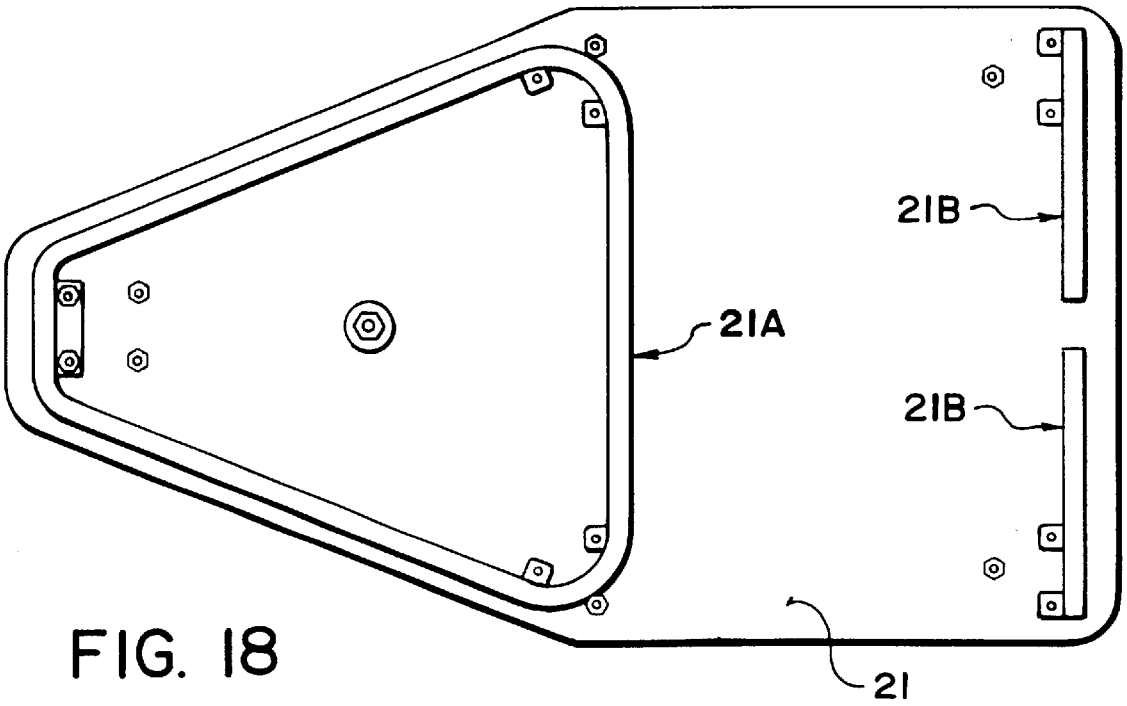

Referring to FIGS. 1 and 2 or to FIGS. 4 and 15, the two side-rail assemblies are fastened to the rear frame assembly by means of upper and lower through-bolts at each rear corner, four through-bolts total. The bolts pass through the upright members of the side-rail and rear frame assemblies and terminate in self locking nuts at the back. The side-rails are fastened to the floor assembly by means of three screws through the foot pad of each leg, 12 screws total. Referring to FIG. 6 for the residential unit, two of the screws through each front foot pad, also attach the rear end of the stiffener, 21A, to the floor by means of the self locking nuts on the mounting tabs. Two of the screws at each rear foot pad attach the leveler 21B to the floor by means of self locking nuts on the mounting tabs. The remaining screws, one at each foot pad, terminates in nuts held captive by the floor itself. The foot pads, stiffener, and levelers for the clinical unit attach to the floor in a similar manner (see FIG. 18).

Each of the legs 23 and 24 has a pull pole 23A and 24A bolted to its front face so as to stand upwardly therefrom to a convenient height of at least of the order of 3.5 feet and possibly higher so that it can be grasped and comfortably held by the patient when the patient is in a standing position. A stand-alone pull-pole 5 is fastened to the floor assembly 21 by means of four screws, two of which also attach the front end of the stiffener to the floor by means of self locking nuts on the mounting tabs (see FIG. 6). The remaining two screws terminate in nuts held captive in the floor material. The pole 5 includes a surrounding sleeve 5A at its lower end which is welded to the bottom pad and is connected to the pole 5 at the top end by an annular plate 5B.

The assistive device has a floor to which are physically attached, a number of the objects with which a hemiplegic must interact; three pull-poles 5, 23A, 24A; the pivot disk 7; and the built-in commode 6 or the bench seat 30. In other words, the floor establishes and maintains the fixed physical relationships between the various object with which the user interacts. Without a free hand to locate and steady an object of interaction, a hemiplegic relies on the object's fixed location and rigid behavior. Accordingly, the floor plays a large role in the safety and peace of mind of the user.

FIG. 6 gives a plan view of the floor assembly for the residential unit showing the outriggers 81 attached to the stiffener frame 21A, which makes the base of the device, the floor, effectively much wider. More specifically, the effective width of the base of the device is the length of the outriggers. Similarly outriggers may be attached to the clinical device of FIG. 14. An object will not tip over until the vertical projection of its center of gravity intersects its resting surface outside of the boundaries of its base. Accordingly, the device will not tip over until someone standing therein, manages to get the combined center of gravity of their body and the assistive device beyond the ends of the outriggers (approximately 8 inches beyond the rails whose locations are identified by the long dashed lines 27A between the legs). This is very unlikely to occur, if not impossible. Consequently, the outriggers makes the assistive device tip-over-resistant for normal usage in the absence of dangerous, reckless, or deliberate actions.

Figure 4A:
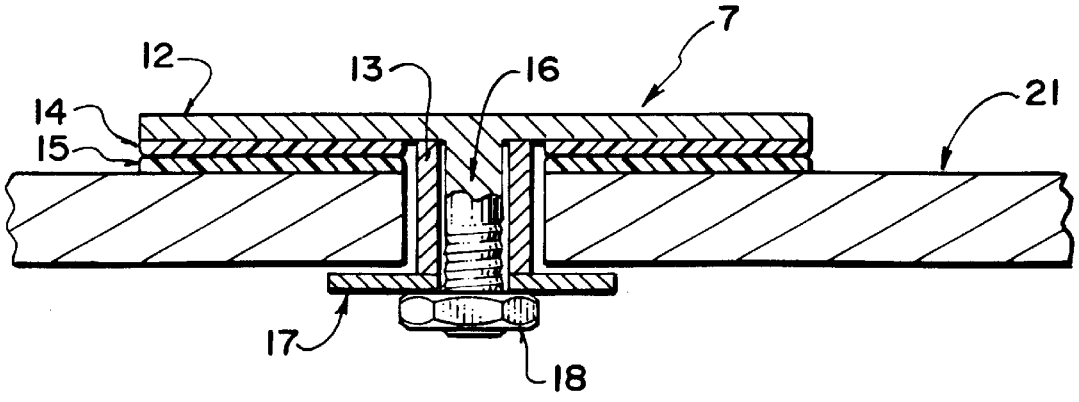
FIG. 4A is a cross sectional view of the pivot plate of the device of FIG. 1.

Shown in FIG. 4A is a cross section of the pivot disk assembly 7. It consists of a round metal disk 12 with integral screw 16; a metal sleeve 13 that sticks through the floor; two plastic bearing disks 14 and 15; a washer 17 and a self locking nut 18 to hold the assembly together and in place. The pivot disk provides a smooth, easy rotation, when powered by body movement only, even under the weight of a heavy person.

Figure 11:
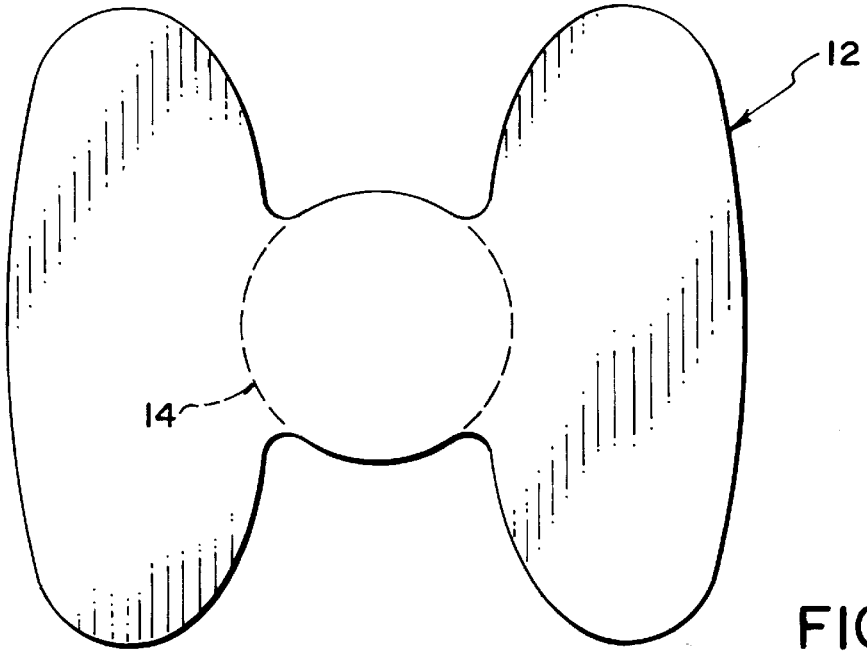
FIG. 11 is a plan view of an alternate pivot disk to the circular one shown in a number of figures including in FIG. 1.
Figure 11A:
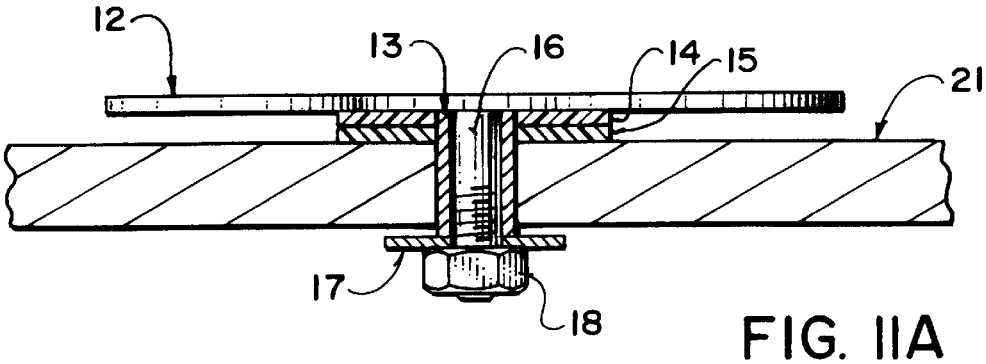
FIG. 11A is a cross section of the pivot disk of FIG. 11 showing plastic bearings and the manner in which the disk is mounted to the assistive device.

Alternate configurations of the pivot disk assembly are illustrated in FIGS. 11 and 11A in which the disk has a single or double wing on which the paralyzed foot can be placed and supported, to ride along rather than dragged along as is the case for disks without wings. It consists of a disk 12 having a single or a double wing with integral screw 16; a metal sleeve 13 that sticks through the floor; two plastic bearing disks 14 and 15; a washer 17 and a self locking nut 18 to hold the assembly together and in place. The central area of the disk is used for the good foot with the heel extending beyond the edge of the central area for pressing on the floor to control rotation.

Figure 9:
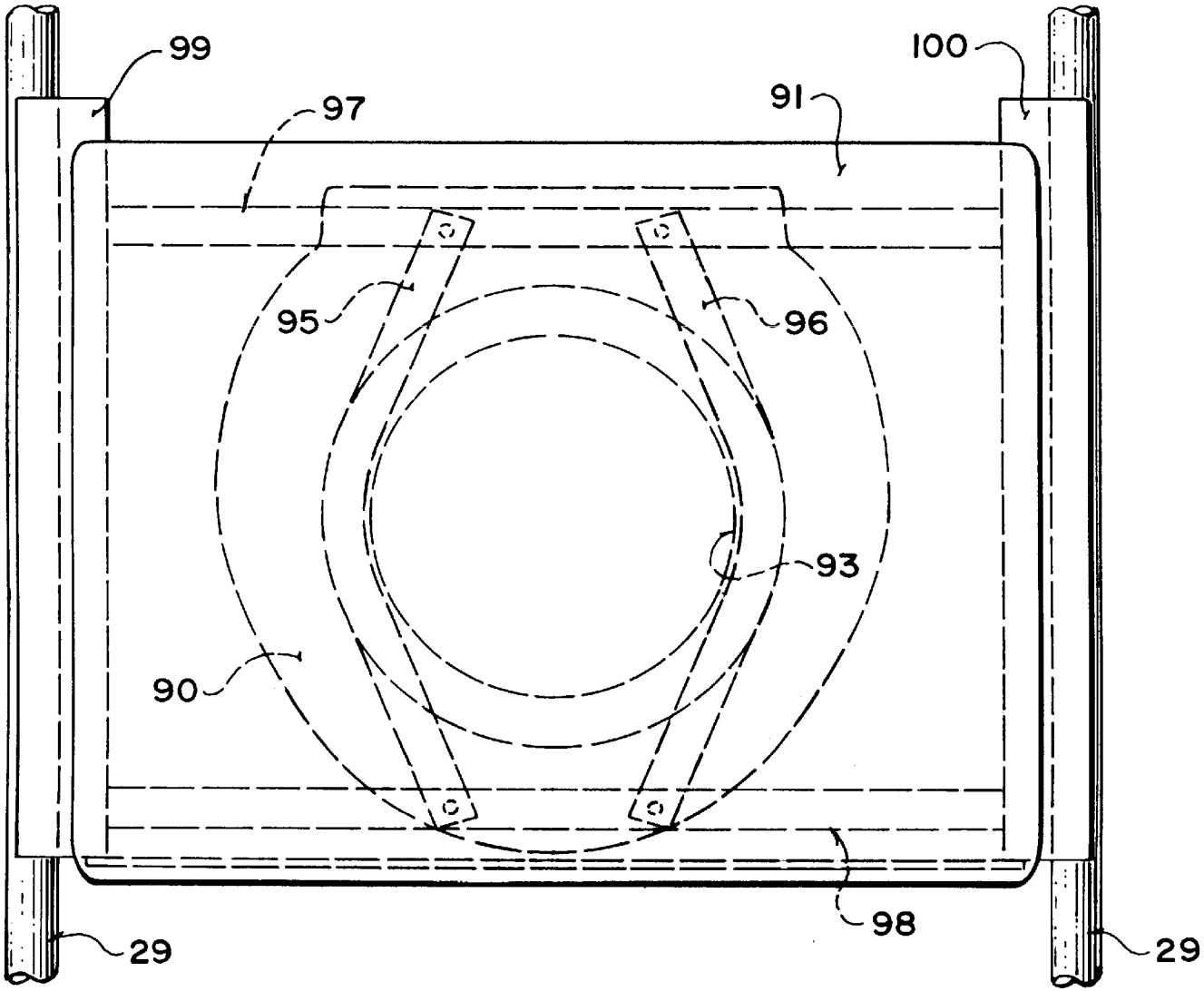
FIG. 9 is a top plan view of the bench seat portion only of the chair of FIGS. 2 and 15 showing an optional commode.
Figure 10:
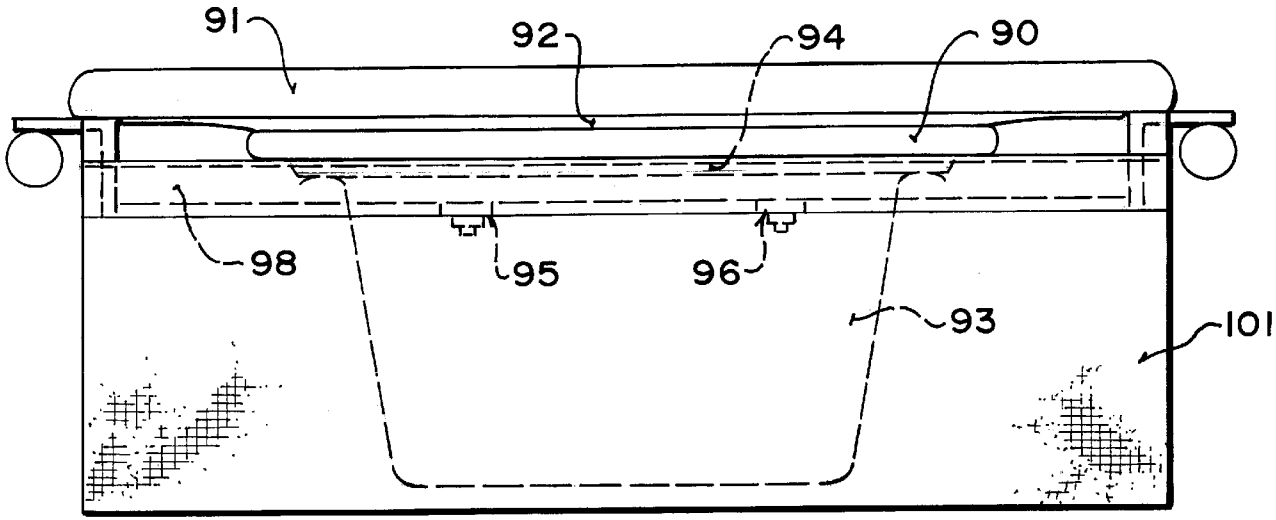
FIG. 10 is a front elevational view of the seat portion and commode installed in the device of FIG. 9.
Figure 10A:
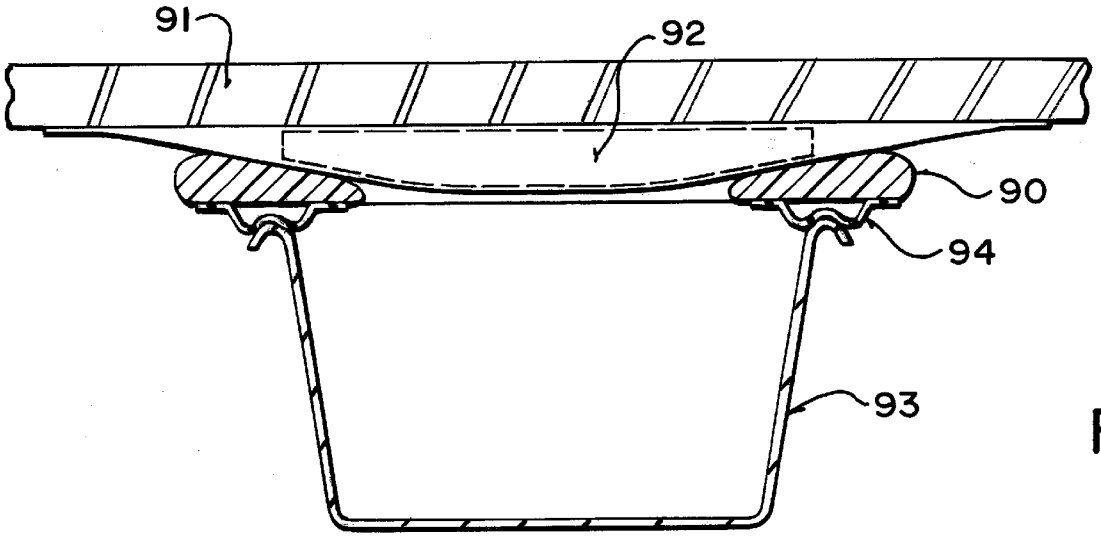
FIG. 10A is a cross sectional view of the elevation view of FIG. 10, showing the odor sealing system of the commode.

The built-in commode 6 is identified in FIG. 2 and is shown in more detail in FIGS. 9, 10 and 10A. The commode is tip-over-resistant by virtue of its direct attachment to the tip-over-resistant device. The toilet seat cover 91 is a rectangular padded, fabric-covered full width (almost rail to rail) bench seat as shown in FIGS. 9 and 10. The wide bench seat makes it ideal for sitting activities such as for dressing. The built-in commode has an odor sealing system of elements as shown in FIG. 10A. On the underside of the bench seat 91 is an odor seal 92 that is contoured to fit the top side of the toilet seat 90 by means of properly sized and shaped sponge material located between the seat's underside structure and its underside non-breathing covering fabric. On the underside of and attached to the toilet seat 90 is an annular odor seal 94 that seals against the lip of the pail 93 as shown in the vertical cross section of FIG. 10A. When the bench seat is lowered the commode becomes odor sealed. Preparing the commode for use becomes the one step process of raising the bench seat. Otherwise, it is a difficult five step process for a hemiplegic (raise the bench seat, raise the toilet seat, remove the lid of the bucket, set the lid aside, then lower the toilet seat for use). The pail is suspended on two generally arcuate bars 95 and 96 which extend between a rear cross bar 97 and a front cross bar 98. The cross bars span the space between and are supported on the vertical flange of two angle irons 99 and 100 each of which has a top flange hanging on the respective side rail 29. The commode has a surrounding skirt 101 to camouflage its purpose.

To transfer from the bed to the commode, a hemiplegic must perform the following steps, (see FIG. 2 to locate the items referred to). The steps recited are for a right-side-normal hemiplegic for whom the bed is located on the left side of the assistive device.

1) Reach through the left side-rail assembly, 4, and raise the bench seat 30.

2) Grasp the horizontal rail 27 or the front leg 24 of the left side-rail assembly 4 and pull self to a sitting position with the right leg dangling over the edge of the bed.

3) Place the ball of their right foot on the pivot disk 7.

4 With their right hand, move their paralyzed left leg into position so that their left foot is beside their right foot, or place their left foot on a wing of the single or double winged pivot disk as the case may be.

5) Reach forward and grasp the pole 23A in front of them.

6) Pull their body to a standing position (the ball of their foot still on the pivot disk 7).

7 Raise their heel off the floor and pivot 90° on the disk counterclockwise swiveling their center of gravity around the axis of the disk.

8) Lower their heel back onto the floor to prevent any further rotation.

9) Reach forward and grasp the pole in front of them; in this case, pull-pole 5.

10) Slowly lower their body onto the commode's toilet seat (beneath 30).

Figure 12:
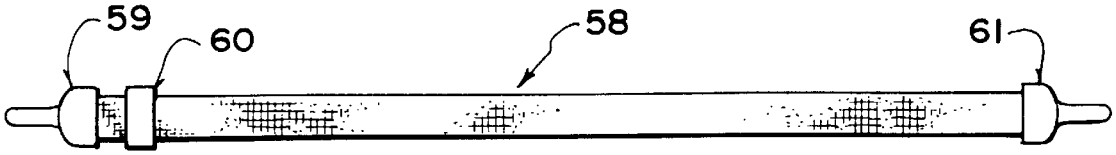
FIG. 12 is an assembly type drawing showing the features of the restraining belt for the devices of FIGS. 2 and 15.

As illustrated in FIG. 2, the assistive device has a restraining belt 58 to keep hemiplegics from falling forward and injuring themselves while dressing. The belt is designed to be employed by the residential assistive device assembled for either a left-side or a right-side-normal hemiplegic, and to be employed by the clinical assistive device when used by either a left side or right side-normal hemiplegic. Accordingly, the restraining belt as shown in FIG. 12 has a clasp at each end, between which is a belt of traditional safety belt material and a length adjustment mechanism 60 which is nearest to clasp 59 identified as the fixed clasp. The other clasp 61 is identified as the moving clasp.

For the residential assistive device assembled for right-side-normal hemiplegics (see FIG. 2), the terminating rings for the clasps are identified as 102A, B, and C; rings 102A and 102B are attached to the left and right sides respectively, of the seat or commode assemblies, while ring 102C is attached to the rear side of leg 23. The fixed clasp terminates in ring 102B, while the moving clasp terminates in ring 102A when employed and 102C when not employed. When the residential device is assembled for a left-side-hemiplegic (a mirror image figure not shown), the restraining belt is similarly employed.

For the clinical assistive device (see FIG. 15), the terminating rings for the clasps are identified as 102A, through 102D; rings 102A and 102B are attached to the left and right sides respectively, of the seat or commode assemblies, while ring 102C is attached to the rear side of leg 23, and 102D to the rear side of leg 24. For a right-side-normal hemiplegic, the fixed clasp terminates in ring 102B, while the moving clasp terminates in ring 102A when employed, and ring 102C when not employed. For a left side-normal hemiplegic, the fixed clasp terminates in ring 102A, the moving clasp in ring 102B when employed and in ring 102D when not employed.

Figure 5:
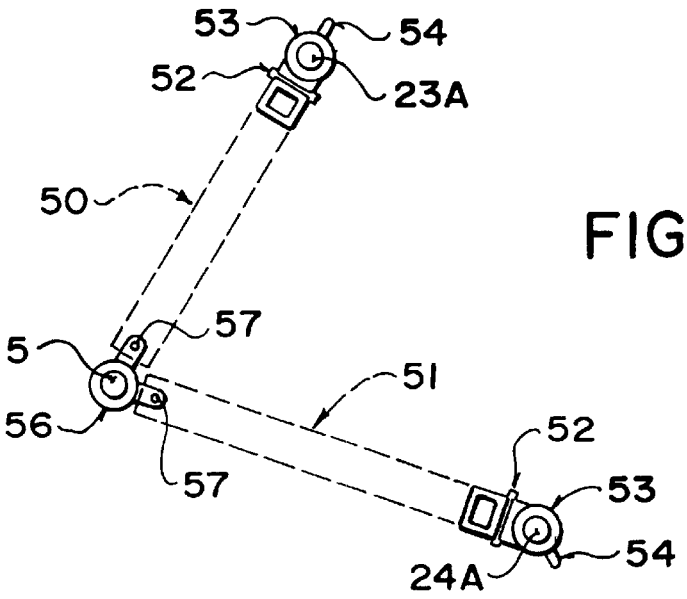
FIG. 5 is a top plan view of the device of FIG. 1 showing the pull poles only together with the crossbars attached thereto in dropped position and showing the deployed position in dash line.

The assistive device has deployable standing up safety bars 50 and 51 to lean against while dressing as shown in FIG. 4 and FIG. 5 since hemiplegics do not have a free hand to steady themselves. The safety bars for the clinical unit, are deployable by the patient; one between pull-poles 5 and 23A and the other between poles 5 and 24A forming a V-shaped safety restraint. The safety bars are made of 1¼" square tube. At poles 23A and 24A, the safety bars 50 and 51 respectively attach via horizontal hinges 52 attached to collars 53 that fit over the poles at the height selected by adjustment pins 54. The height is arranged adjacent the torso of the patient. The collar 53 is free to rotate about its pole. Thus the attachment mechanism enables the safety bars to hang down along the respective pole and rotate out of the way when not in use. Located on pole 5 at the same selected height is a similar collar with two vertical pins 57 pointing upward along side the pole 5 but facing the respective pole 23A, 24A. At their free ends, each bar 50, 51 has a mating vertical hole for their respective pin 57. The safety bars can be deployed by rotating them about the pole 23A, 24A to the proper location facing the pole 5, then swinging their free end up and placing the hole over the pin 57. The mating hole and the pin for each bar have cooperating mechanisms (not shown) that lock the bars in place until the lock is released intentionally.

In rehabilitation and training environments, such as in clinics and hospitals, there is a need to be able to change the height of the seat/commode (91/99) to suit the height of the next patient quickly. This is accomplished by the use of the quick adjustment kit shown in FIGS. 13 and 13A. For each side of the hemiplegic assistive device, the kit consists of one handle 103, two long carriage bolts 104 which act as mounting rods for the height adjusting spacers 106, two jam nuts 105 to attach the handle and mounting rods to the commode frame 99, two or more height adjusting spacers 106, a base bar 107 on which the bottom spacer rests, and two wing nuts 108 which terminate the carriage bolts.

Figure 13:
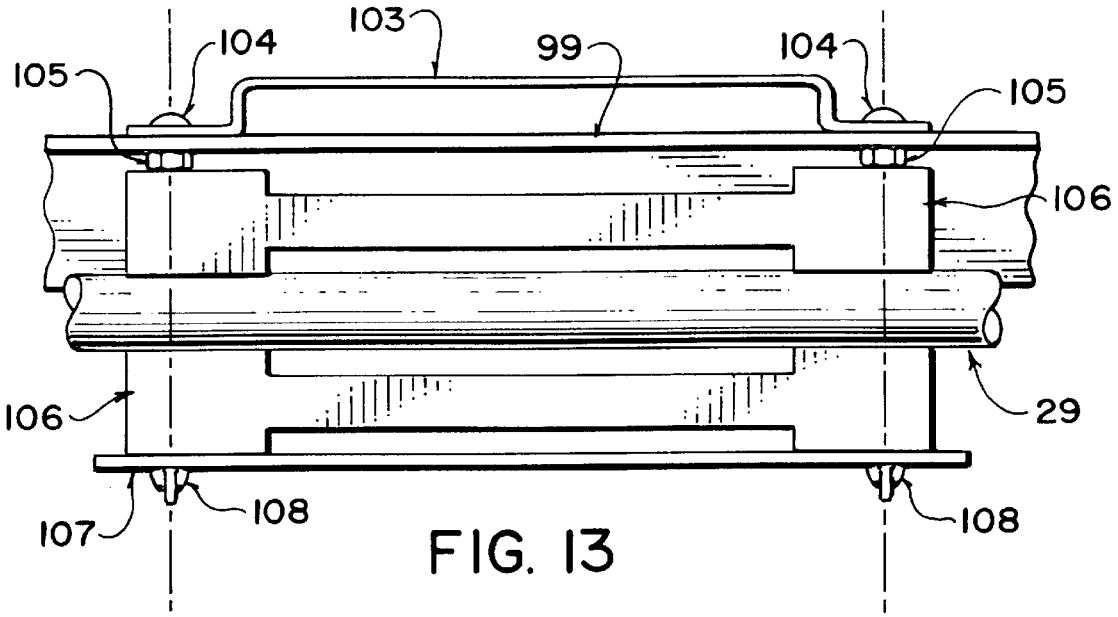
FIG. 13 is a front elevation view of a quick adjustment mechanism made for adjusting the seat height of the device of FIGS. 1 and 14, not shown in those figures.
Figure 13A:
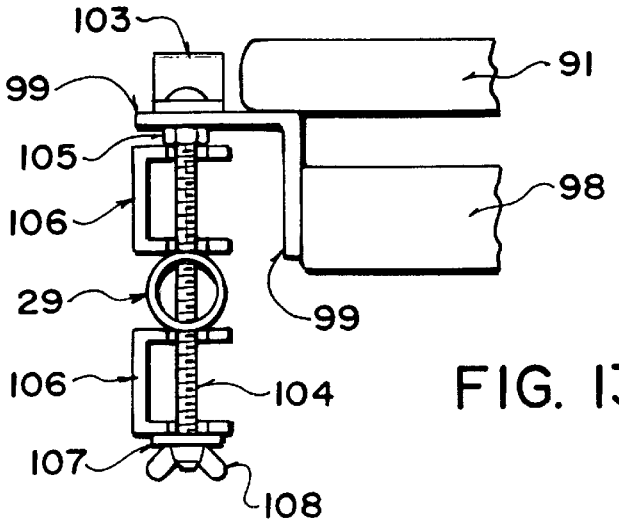
FIG. 13A is a side elevation view of the quick adjustment mechanism made for adjusting the seat height of the device of FIGS. 1 and 14.

With reference to FIGS. 13 and 13A which give a front and an end elevation view respectively, the frame of the seat/commode 91/99 normally rests directly upon the rail's cross member 29 whose height adjustment is a rather lengthy disassemble/reassemble procedure. With the kit, the height of the cross-member remains fixed and the procedure to raise the seat involves loosening the two wing nuts 108 on each side of the device a few turns, removing a spacer 106 from below the cross member 29, grasping the handle 103, raising the seat, inserting the spacer 106 above the cross member, and then retighten the wing nuts 108. To lower the seat, spacers are removed from above the cross member and relocated on the mounting rods beneath it.

Figure 13B:
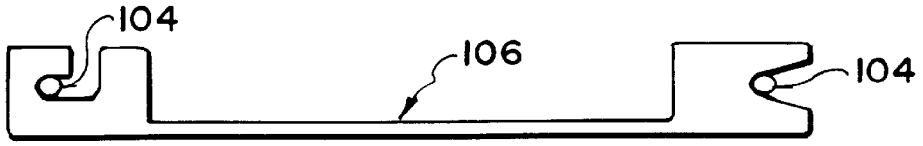
FIG. 13B is a plan view of a specific horizontal plane of the quick adjust mechanism of FIG. 13 which shows the simplicity and ease with which the seat height can be adjusted.

It can be seen from the elevation views of FIG. 13 that a spacer consists of two end sections made from U-channels laying on their sides, interconnected by a reduced section that acts as a handle. FIG. 13B is essentially the plan view of a horizontal plane at the top of a spacer. It shows that the design of the spacers enables them to be held in place by the mounting rods, but still be easily removed by a three step movement; move the spacer to the left until it stops (see the slot detail on the left section), pull the spacer towards you (downward in the figure) until it clears the slot, then move the spacer again to the left until it clears the horizontal V-slot in the right section. To remove the spacer, the movements are basically, "push left/pull out/push left". To re-install the spacer, the movements are basically, "push right/push in/push right". Although the quick adjustment kit is designed for use by the Clinical assistive device, by similarity of construction, it may be used with the Residential unit as well.

Figure 7:
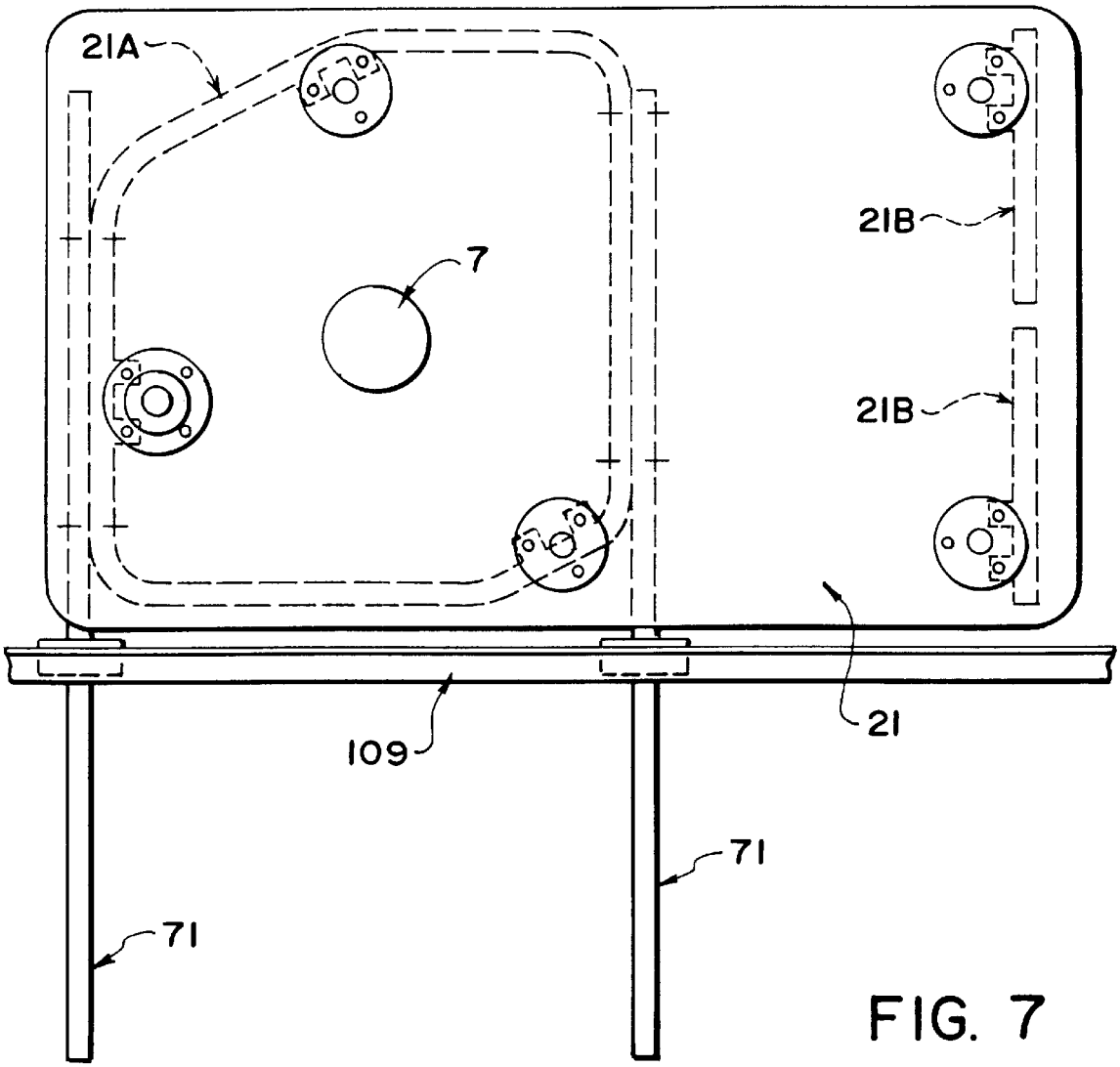
FIG. 7 is a top plan view of the device of FIG. 1 showing a bed frame, the floor of the device, the foot pads of the chair legs, and the pin down bars which extend underneath the bed. Its purpose is to provide a visualization of the pin-down stabilization system.
Figure 8:
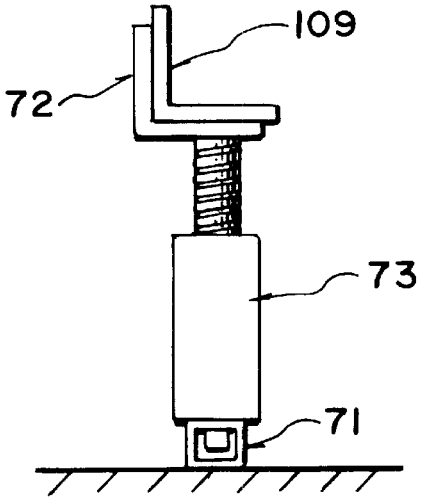
FIG. 8 is an elevation view of the pin-down jack of FIG. 7 showing its interfaces with the bed frame and a pin-down bar.

In the pin-down stabilization system shown in FIGS. 7 and 8 for a residential assistive device, pin-down bars (steel tubes) 71 are pinned to the floor by the weight of the bed. The weight of the bed is imposed on the pin-down bars by the adjustable jack which spans the distance between the bed frame and the bars as shown in FIG. 8. The jack has two parts; the non-rotating part 72 which includes an angle iron and threaded shaft is forced up against the bed frame by turning the tightening shaft 73 which is anchored to the pin down bar by an intrusive pin into a hole in the bar, thereby making the assistive device tip-over-resistant. By similarity of construction, the pin-down technique works equally well for clinical assistive devices.

Figure 20:
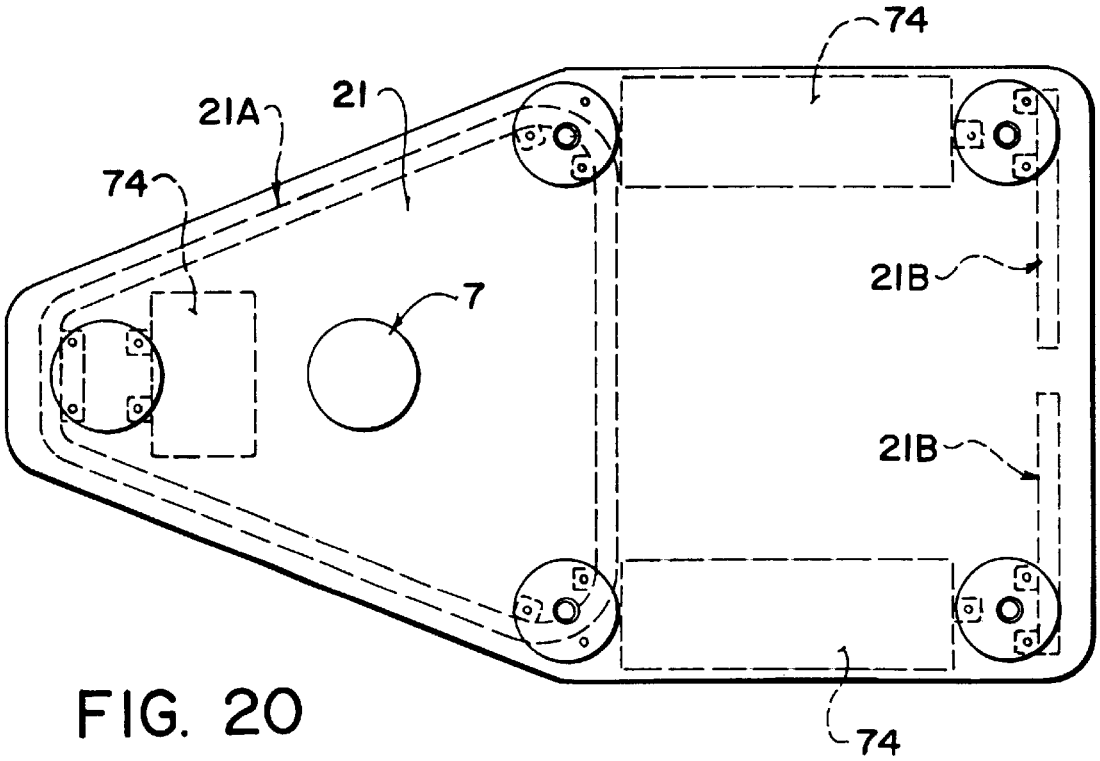
FIG. 20 is a plan view of the device of FIGS. 14 to 18 showing the floor, stiffener frame, leveller plates and stick down pads, which illustrates the stick down method of stabillization.

In the stick down stabilization system shown in FIG. 20 for a clinical assistive device, mating Velcro strips are used to stick the assistive device to hard surfaced floors. Mating Velcro strip have a system of hooks on one mating surface and a system of loops on the other. When brought together the fastening action is caused by hundreds of hooks catching into loops. Velcro strips are relatively easy to separate by using a peeling action. However, on a straight separating pull basis without any peeling action, the force required may exceed 100 pounds depending on the mating area involved and the specifications of the Velcro. In this stabilization system, the self adhesive "hooks" matting is fastened to the underside of the stick-down plates 74 shown in FIG. 20. The self adhesive "loops" matting is fastened in matching patterns to hard surfaced floors in a number of locations of interest, thereby making the assistive device tip-over-resistant and easily transferable amongst the specific locations of interest. By similarity of construction, the stick-down technique works equally well for residential assistive devices.

Figure 19:
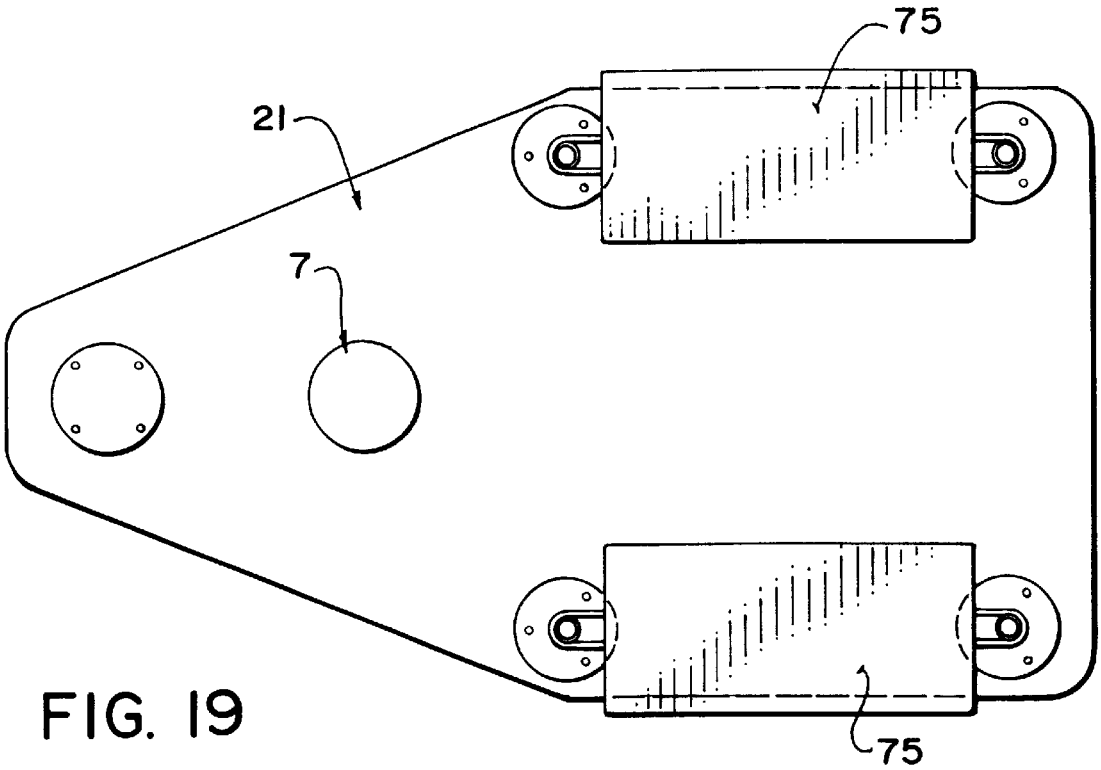
FIG. 19 is a plan view at device-floor-level of the device of FIG. 14 showing the floor with foot pads, and the placement of ballast tanks on the top of the device floor near thereto. Its purpose is to provide a visualization of the ballast tank stabilization system.

In the ballast tank stabilization system shown in FIG. 19, ballast tanks 75 filled with approximately ½ cubic foot of water rest on the floor 21 of the device and are held in place by attachment to the legs, thereby making the assistive device tip-over-resistant.

What is claimed is:

1. A mobility assisting device for infirm patients comprising:

a base surface on which the patient can stand;

a chair construction on the base surface having two side rails and a horizontal seat;

three vertical pull-poles extending upwardly from the base surface arranged thereon generally at apexes of a triangular pattern for the patient to pull on for standing up, or for lowering back to a sitting position;

a first of the pull-poles being arranged at the front of the chair on one side, a second of the pull-poles being arranged at the front of the chair on the other side and a third of the pull-poles being spaced forwardly of the chair between the first and second poles with the poles being spaced such that the user can pass between the first and third poles to enter or leave the chair from one side and between the second and third poles to enter or leave the chair from an opposed side.

2. The device according to claim 1 having a pivot disk located on the base surface adjacent at least one of the pull-poles shaped and arranged to receive one foot of the patient while holding one of the pull-poles and rotatable about a vertical axis relative to the base surface such that the patient can pivot on the pivot disk and thereby point their posterior in a required direction in order to sit down on an object of their choice.

3. The device according to claim 2 wherein the pivot disk is arranged generally centrally between the pull-poles.

4. The device according to claim 2 wherein the pivot disk has a central portion shaped to receive the ball of the good foot of the patient and a wing or wings projecting outwardly from the pivot axis shaped to receive and support the ineffective foot of the patient.

5. The device according to claim 1 wherein the base surface comprises a floor that establishes and maintains the relative positions of the pull-poles, the pivot disk and the seat.

6. The device according to claim 1 wherein the chair includes a commode.

7. The device according to claim 6 wherein a cover for the commode comprises a bench seat.

8. The device according to claim 1 wherein the commode includes a toilet seat and the bowl is odor sealed by a seal underneath the bench seat which sits on the toilet seat and a seal under the toilet seat which sits on the bowl.

9. The device according to claim 1 that incorporates a restraining belt across side rails of the chair construction to keep a one-handed user from falling forward and being injured while dressing.

10. The device according to claim 1 that has lean-against safety bars between the pull-poles to lean against when standing while dressing.

11. The device according to claim 1 that has a quick adjust mechanism to adjust a height of the seat relative to the chair.

12. The device according to claim 1 wherein there is provided a mounting frame for holding the chair construction and the pull-poles in position and wherein there is provided an adjustable pin-down jack by which is arranged to imposes the weight of an adjacent bed between a bed frame and a pin-down bar attached to the mounting frame, thereby making the assistive device tip-over-resistant.

13. The device according to claim 1 including an outrigger stabilization system in which outriggers are attached to the base surface at each of a plurality of footpads of the chair construction to make the base surface effectively wider from a stabilization standpoint.

14. The device according to claim 1 including a stick-down stabilization system in which stick-down plates are attached to an underside of the base surface which utilizes self-sticking hook and loop strips to stick the base surface to a hard surfaced floor, thereby making the assistive device tip-over-resistant while still providing transferability.

15. The device according to claim 1 including ballast tanks attached to legs of the chair construction and resting on the base surface on respective sides of the chair construction to counteract the tip-over torque generated by a pull on a pole or a lunge of the body against the chair construction.

16. A mobility assisting device for infirm patients comprising:

a base surface on which the patient can stand;

at least one vertical pull-pole standing upwardly from the base surface for grasping by the patient to assist in moving from one place to another place;

and a pivot disk located on the base surface adjacent the pull-pole shaped and arranged to receive one foot of the patient while holding the pull-pole and rotatable about a vertical axis relative to the base surface such that the patient can pivot on the pivot disk and thereby point their posterior in a required direction in order to sit down on an object of their choice.

17. The device according to claim 16 wherein the pivot disk has a central portion shaped to receive the ball of the good foot of the patient and a wing or wings projecting outwardly from the pivot axis shaped to receive and support the ineffective foot of the patient.

18. The device according to claim 16 wherein the base surface comprises a floor that establishes and maintains the relative positions of the pull-poles and the pivot disk.

* * * * *